US008270890B2

(12) United States Patent
Arai et al.

(10) Patent No.: US 8,270,890 B2
(45) Date of Patent: Sep. 18, 2012

(54) CLEANING DEVICE, IMAGE HOLDER DEVICE, AND IMAGE FORMING APPARATUS

(75) Inventors: Kazuhiko Arai, Ebina (JP); Mitsuo Yamamoto, Ebina (JP); Koichiro Yuasa, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 388 days.

(21) Appl. No.: 12/714,022

(22) Filed: Feb. 26, 2010

(65) Prior Publication Data

US 2011/0020041 A1 Jan. 27, 2011

(30) Foreign Application Priority Data

Jul. 21, 2009 (JP) ..... 2009-169912

(51) Int. Cl.
*G03G 21/00* (2006.01)

(52) U.S. Cl. ..... 399/358

(58) Field of Classification Search ..... 399/123, 399/343, 358–360
See application file for complete search history.

(56) References Cited

U.S. PATENT DOCUMENTS

| | | | | |
|---|---|---|---|---|
| 6,219,523 | B1 * | 4/2001 | Kobayashi | 399/358 |
| 6,418,297 | B1 | 7/2002 | Yamatani | |
| 7,369,796 | B2 * | 5/2008 | Amano et al. | 399/254 |
| 2003/0007815 | A1 * | 1/2003 | Takami | 399/359 |
| 2010/0322686 | A1 * | 12/2010 | Yamamoto | 399/358 |

FOREIGN PATENT DOCUMENTS

| | | | |
|---|---|---|---|
| JP | 2000-181315 | A | 6/2000 |
| JP | 2001-83854 | A | 3/2001 |
| JP | 2006-227127 | A | 8/2006 |

* cited by examiner

*Primary Examiner* — Walter L Lindsay, Jr.
*Assistant Examiner* — Rodney Bonnette
(74) *Attorney, Agent, or Firm* — Sughrue Mion, PLLC

(57) ABSTRACT

A cleaning device includes: a removing unit that removes a toner on an image holder by coming into contact with the image holder that rotates; a transporting unit provided above the removing unit and adapted to cause the toner removed by the removing unit to be axially transported as the transporting unit rotates; and an accommodating container in which the transporting unit is provided and which accommodates the removed toner, and the transporting unit is movable in a direction in which the transporting unit moves away from the removing unit.

10 Claims, 4 Drawing Sheets

CLEANING DEVICE, IMAGE HOLDER DEVICE, AND IMAGE FORMING APPARATUS

CROSS-REFERENCE TO RELATED APPLICATIONS

This application is based on and claims priority under 35 USC 119 from Japanese Patent Application No. 2009-169912 filed on Jul. 21, 2009.

BACKGROUND

Technical Field

The present invention relates to a cleaning device, an image holder device, and an image forming apparatus.

SUMMARY

According to an aspect of the invention, there is provided a cleaning device including: a removing unit for removing a toner on an image holder by coming into contact with the image holder which rotates; a transporting unit provided above the removing unit and adapted to cause the toner removed by the removing unit to be axially transported as the transporting unit rotates; and an accommodating container in which the transporting unit is disposed and which accommodates the removed toner, wherein the transporting unit is movable in a direction in which the transporting unit moves away from the removing unit.

BRIEF DESCRIPTION OF THE DRAWINGS

Exemplary embodiments of the present invention will be described in detail based on the following figures, wherein.

DESCRIPTION OF REFERENCE NUMERALS AND SIGNS

1: printer, 41: photoconductor drum, 421: housing, 421*a:* elongated hole, 422: cleaning blade, 424: transport member, 424*a:* rotating shaft, 424*b:* transport blade, 425*b:* drive shaft, 425*c:* drive pulley, 425*d:* driven pulley, 425*e:* belt, 427: sponge, 427*a:* hole, T: waste toner

DETAILED DESCRIPTION (Schematic Configuration of Printer)

Figure 1:
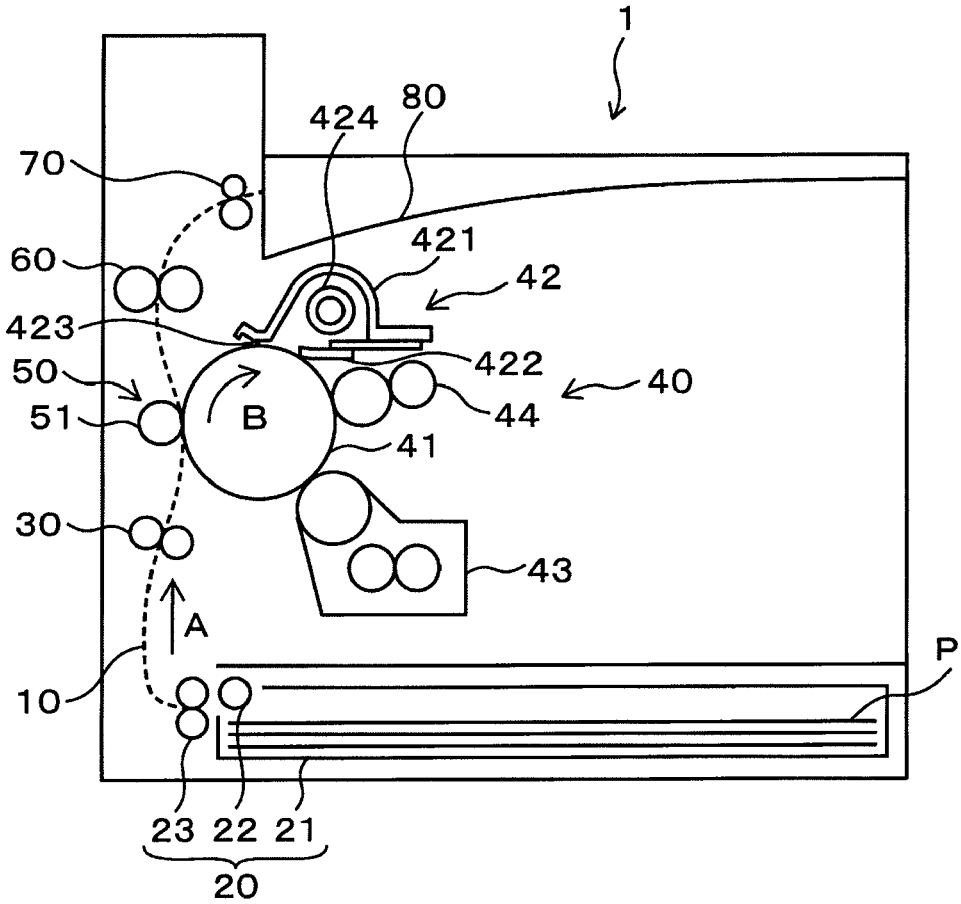
FIG. 1 is a schematic diagram illustrating a printer.

Hereafter, a description will be given of an exemplary embodiment of the invention with reference to the drawings. First, referring to FIG. 1, a description will be given of the schematic configuration of a printer as an example of the image forming apparatus. In FIG. 1, reference numeral 1 denotes a printer. A sheet transporting passage 10 along which a sheet P is transported in the direction of arrow A in FIG. 1 is formed in the printer 1 from a bottom portion to an upper portion of the printer 1. Starting from the downstream side of the sheet transporting passage 10, a feeder 20, a registration roller pair 30, an image forming unit 40, a transfer device 50, a fixing device 60, a discharging device 70, and a discharge section 80 are provided in the printer 1 in such a manner as to be arranged along the sheet transporting passage 10. The printer 1 prints a monochromatic image on the sheet P.

In the printer 1, image data is supplied to an unillustrated control unit through a predetermined communication line from an unillustrated image output apparatus such as a personal computer and an image reading apparatus. The unillustrated control unit issues a control command for image formation to such as the image forming unit 40 on the basis of the image data supplied thereto. In addition, the unillustrated control unit controls the overall operation of the printer 1 including this operation of image formation.

The feeder 20 is provided in the bottom portion of the printer 1. The feeder 20 includes a paper storage section 21 in which the sheets P are stacked, an extraction roller 22 for drawing out one sheet P from the paper storage section 21, and a transport roller pair 23 for feeding the sheet P from the feeder 20 to the sheet transporting passage 10. The feeder 20 supplies the sheets P.

The registration roller pair 30 for controlling the position of the sheet P is provided downstream of the feeder 20 in the transporting direction (direction of arrow A in FIG. 1) of the sheet P. The sheet P which has been drawn out from the paper storage section 21 and fed to the sheet transporting passage 10 is fed to the transfer device 50 at a predetermined timing by the registration roller pair 30.

The image forming unit 40 is an example of an image holder device, and is provided in a central portion of the printer 1. The image forming unit 40 has a photoconductor drum 41 as an example of the image holder. The photoconductor drum 41 is formed in a solid cylindrical shape or a hollow cylindrical shape. The photoconductor drum 41 is brought into contact with the sheet P by a side surface of the photoconductor drum 41. The photoconductor drum 41 rotates in the direction of arrow B in FIG. 1, and holds a toner image.

In the image forming unit 40, a cleaning mechanism 42 for cleaning the surface of the photoconductor drum 41, a charger 44 for electrically charging the surface of the photoconductor drum 41, and a developing device 43 for developing a latent electrostatic image formed on the surface of the photoconductor drum 41 are formed around the photoconductor drum 41 in that order along the direction of arrow B in FIG. 1.

According to the image forming unit 40, the photoconductor drum 41 which rotates is electrically charged by the charger 44, and a latent electrostatic image corresponding to the image data is formed on the surface of the photoconductor drum 41. Next, as the latent electrostatic image formed on the surface of the photoconductor drum 41 passes the developing device 43, the toner is supplied from the developing device 43 to the surface of the photoconductor drum 41, and the toner remains only on the latent electrostatic image on that surface, thereby developing a toner image. After the toner image on the photoconductor drum 41 is transferred onto the sheet P, the toner remains on the surface of the photoconductor drum 41. The remaining toner is removed from the surface of the photoconductor drum 41 by the cleaning mechanism 42.

The transfer device 50 is provided at a position opposing the photoconductor drum 41. The transfer device 50 has a transfer roller 51. The transfer roller 51 rotates while generating transfer pressure with respect to the photoconductor drum 41. In the transfer device 50, the sheet P transported from the paper storage section 21 is inserted between the transfer roller 51 and the photoconductor drum 41 at a timing with the toner image on the photoconductor drum 41, and the toner image is transferred onto the surface of the sheet P. The transferred sheet P is sent to the fixing device 60.

The fixing device 60 is provided downstream of the transfer device 50 in the transporting direction (direction of arrow A in FIG. 1) of the sheet P. The fixing device 60 has a heating roller and a pressurizing roller. As the fixing device 60 transports the sheet P while clamping and heating the sheet P between the heating roller and the pressurizing roller, a transferred image is fixed on the surface of the sheet P. The sheet P with the transferred image fixed thereon is sent to the discharging device 70.

The discharging device 70 is provided downstream of the fixing device 60 in the transporting direction (direction of arrow A in FIG. 1) of the sheet P. The discharging device 70 allows the sheet P with the transfer image fixed thereon by the fixing device 60 to be discharged to the discharge section 80 provided in an upper portion of the printer 1.

(Configuration of Cleaning Mechanism)

Figure 2:
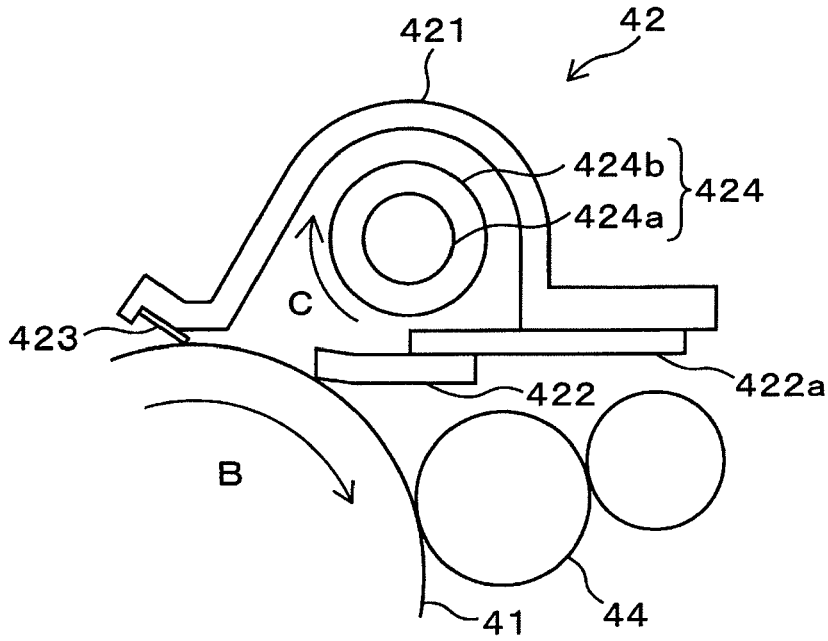
FIG. 2 is a schematic diagram illustrating a cleaning mechanism.

Next, a description will be given of the cleaning mechanism 42. The cleaning mechanism 42 cleans the surface of the photoconductor drum 41, and is installed above the photoconductor drum 41, as shown in FIG. 1. In FIG. 2, reference numeral 421 denotes a housing as an example of an accommodating container. The housing 421 accommodates the toner removed by a cleaning blade 422 (this toner will be hereafter referred to as the waste toner).

The cleaning blade 422 as an example of a removing unit is fixed to one edge of an opening of the housing 421 by means of a bracket 422*a*. The cleaning blade 422 is in contact with an upper portion of the photoconductor drum 41, i.e., a portion which is offset from an apex of the photoconductor drum 41 toward a rotating direction (direction of arrow B in FIG. 2) side of the photoconductor drum 41. The upper portion of the photoconductor drum 41 referred to herein means a range which falls within a central angle of 45 degrees or thereabouts from the apex of the photoconductor drum 41.

The cleaning blade 422 is formed of a rubber material having a length corresponding to the width of that region of the photoconductor drum 41 where the toner image is formed. A leading end of the cleaning blade 422 is in contact with the surface of the photoconductor drum 41. A rear end of the cleaning blade 422 is fixed to one edge of the opening of the housing 421. The cleaning blade 422 removes the toner remaining on the surface of the photoconductor drum 41. The removed waste toner moves from the leading end of the cleaning blade 422 to the inner side of the housing 421 by such as being pushed by the rotational force of the photoconductor drum 41 and the waste toner.

A seal member 423 is fixed to the other edge of the opening of the housing 421. The seal member 423 is provided on the opposite side to the cleaning blade 422 in the rotating direction (direction of arrow B in FIG. 2) of the photoconductor drum 41. The seal member 423 is formed of a film member made of a resin material. As an example, the seal member 423 is formed of polyethylene terephthalate (PET) resin. The leading end of the seal member 423 is in contact with the surface of the photoconductor drum 41. The rear end of the seal member 423 is fixed to the other edge of the opening of the housing 421. The seal member 423 is in contact with the surface of the photoconductor drum 41 by forming an obtuse angle with respect to its rotating direction (direction of arrow B in FIG. 2), thereby preventing the waste toner from returning to the photoconductor drum 41.

A transport member 424 as an example of a transporting unit is provided inside the housing 421. The transport member 424 is provided above the cleaning blade 422 and closer to the bracket 422*a* side than to the leading end of the cleaning blade 422. Additionally, the transport member 424 is provided parallel to the lengthwise direction of the cleaning blade 422, i.e., parallel to the axial direction of the photoconductor drum 41 with which the cleaning blade 422 is in contact.

Figure 3:
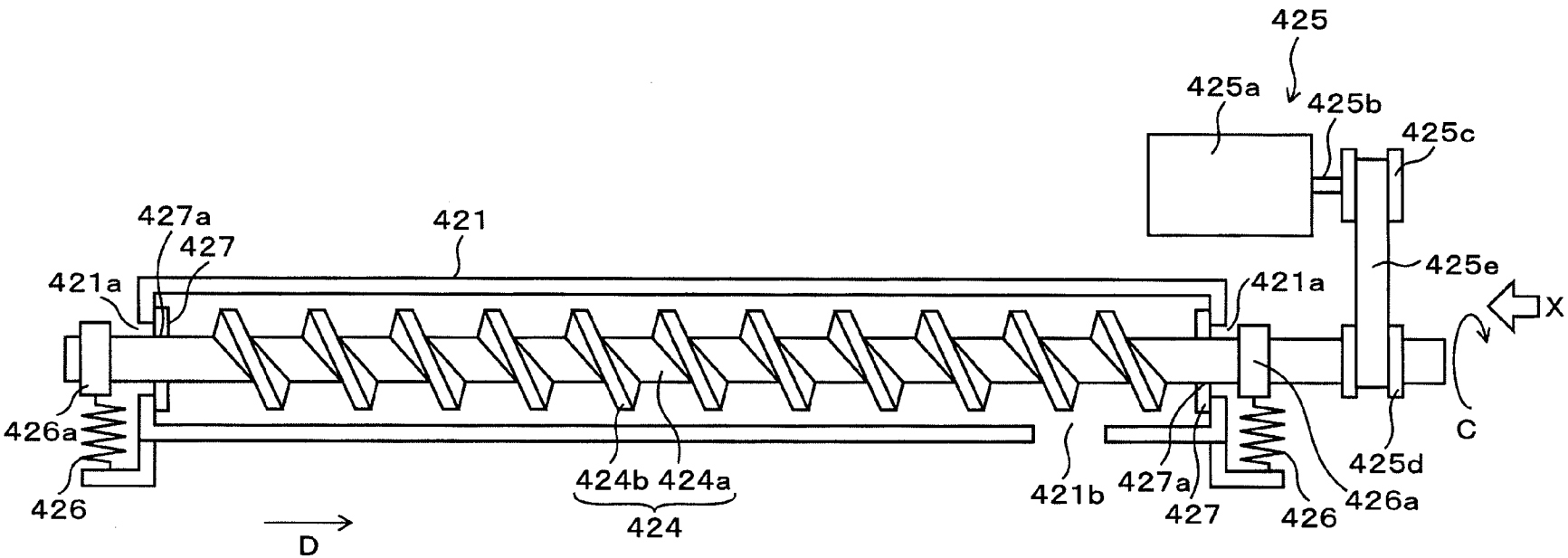
FIG. 3 is a diagram illustrating the relationship among a housing, a transport member, and a power transmitting device.

As shown in FIG. 3, the transport member 424 is arranged such that a spiral transport blade 424*b* as an example of a spiral member is provided around a rotating shaft 424*a*. As for the transport member 424, as the rotating shaft 424*a* rotates in the direction of arrow C in FIG. 3, the transport blade 424*b* rotates, causing the waste toner to be transported in the axial direction (direction of arrow D in FIG. 3) and to be discharged from a discharge hole 421*b* formed in the housing.

Figure 4:
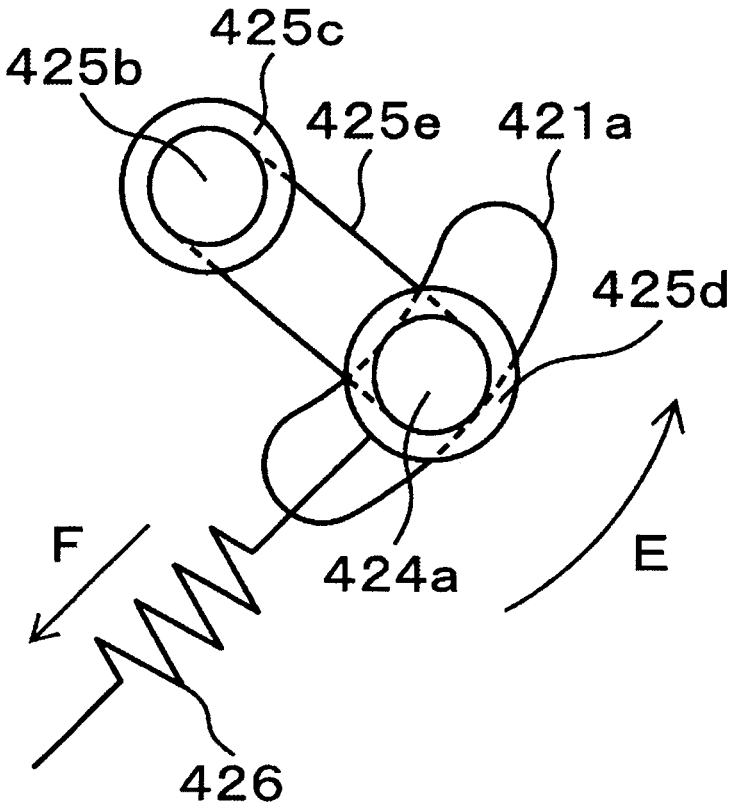
FIG. 4 is a view taken from a direction of arrow X in FIG. 2.

As shown in FIG. 4, a pair of elongated holes 421*a* each serving as an example of a hole portion are formed in the housing 421. Each elongated hole is formed in a circular arc-shape in a diagonally upward direction (direction of arrow E in FIG. 4) as an example of a direction of moving away from the removing unit. The rotating shaft 424*a* of the transport member 424 is rotatably supported in each elongated hole 421*a* movably along the inner periphery of the elongated hole 421*a*.

As shown in FIG. 3, around each elongated hole 421*a*, a sponge 427 as an example of a closure unit is fixed to either inner side surface of the housing 421. The sponge 427 is a fibrous member which is elastically deformable. A hole 427*a*, into which the rotating shaft 424*a* of the transport member 424 is passed, is formed in the sponge 427. As the transport member 424 moves along the elongated holes 421*a*, the sponges 427 are deformed and, without hampering the movement of the transport member 424, prevent the waste toner inside the housing 421 from scattering from the elongated holes 421*a* to outside the housing 421.

As shown in FIG. 3, a driving unit 425 is connected to the transport member 424. The driving unit 425 has a drive motor 425*a*. A drive pulley 425*c* is fixed to a drive shaft 425*b* of the drive motor 425*a*. A driven pulley 425*d* is fixed to one end portion of the rotating shaft 424*a* of the transport member 424. A belt 425*e* is wound around and trained between the drive pulley 425*c* and the driven pulley 425*d*. As for the driving unit 425, as the belt 425*e* rotates in conjunction with the rotation of the drive pulley 425*c*, the driven pulley 525*d* rotates to thereby rotate the transport member 424 in the direction of arrow C in FIG. 3.

The center-to-center distance between the rotating shaft 424*a* of the transport member 424 and the drive shaft 425*b* of the driving unit 425 is set to be equal to the radius of curvature of the elongated hole 421*a*, as shown in FIG. 4. Accordingly, even if the rotating shaft 424*a* moves along the elongated holes 421*a*, the tension of the belt 425*e* does not change.

An annular bushing 426*a* is rotatably fitted on either end of the rotating shaft 424*a*, as shown in FIG. 3, and one end of a spring 426 is fixed to the annular bushing 426*a*. The other end of the spring 426 is fixed to the housing 421. As shown in FIG. 4, the transport member 424 is pulled diagonally downward (in the direction of arrow F in FIG. 4) by the springs 426.

(Operation of Printer)

Next, a description will be given of the operation of the printer 1. In the printer 1, the toner image formed on the surface of the photoconductor drum 41 is transferred onto the sheet P which has been transported from the feeder 20, and the sheet P is sent to the fixing device 60. Then, the transferred image is fixed on the sheet P by the fixing device 60, and the sheet P is discharged to the discharge section 80 by the discharging device 70.

(Operation of Cleaning Mechanism)

Figure 5:
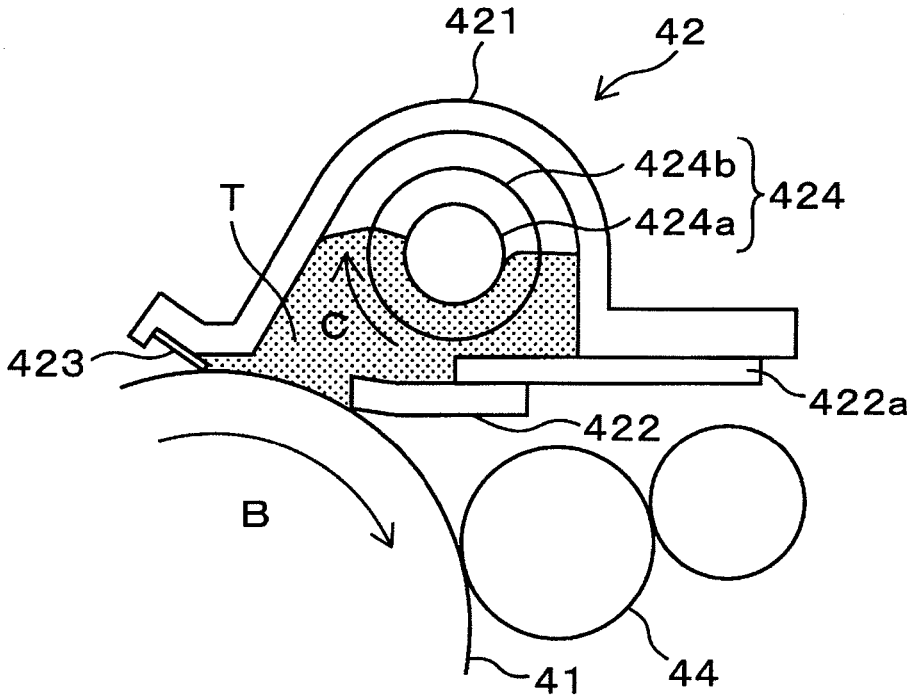
FIG. 5 is a side elevational view for explaining the operation of the cleaning mechanism.

Next, a description will be given of the operation of the cleaning mechanism 42. First, with reference to FIG. 5, a description will be given of the case in which the fluidity of the waste toner is good. Part of the toner supplied from the developing device 43 to the surface of the photoconductor drum 41 is not transferred and remains on the photoconductor drum 41. The remaining toner is removed from the surface of the photoconductor drum 41 by the cleaning blade 422.

Then, the waste toner T removed by the cleaning blade 422 is accumulated in the vicinity of the leading end of the cleaning blade 422. If the amount of the waste toner T accumulated increases, the waste toner T comes into contact with the transport blade 424*b* of the transport member 424. In this case, since the waste toner T is transported without stagnation, the transport member 424 does not move diagonally upward (in the direction of arrow E in FIG. 4) by the force of the springs 426. Then, the waste toner T is transported by the transport blade 424*b* of the transport member 424 and is discharged from the discharge hole 421*b*.

Figure 6:
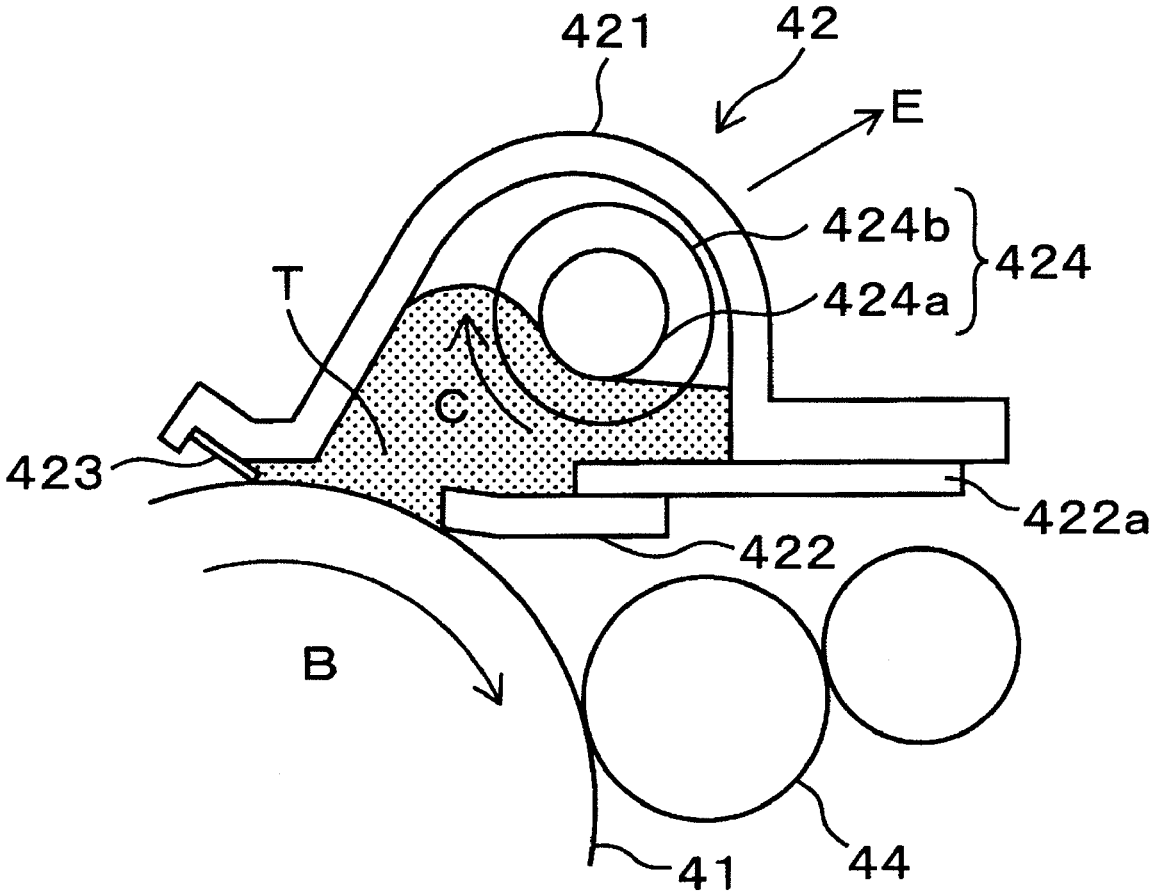
FIG. 6 is a side elevational view for explaining the operation of the cleaning mechanism.

Next, with reference to FIG. 6, a description will be given of the case in which the fluidity of the waste toner is poor. The toner remaining on the photoconductor drum 41 is removed from the surface of the photoconductor drum 41 by the cleaning blade 422. Then, the waste toner T removed by the cleaning blade 422 accumulates in the vicinity of the leading end of the cleaning blade 422. If the amount of the waste toner T accumulated increases, the waste toner T comes into contact with the transport blade 424*b* of the transport member 424. In this instance, since the fluidity of the waste toner T is poor, the waste toner T is difficult to be transported to the transport blade 424*b* of the transport member 424. Then, if the amount of the waste toner T accumulated increases further, the transport member 424 is pushed up by the waste toner T, and is moved diagonally upward (in the direction of arrow E in FIG. 6) in opposition to the force of the springs 426.

As the transport member 424 is moved, the belt 425*e* of the driving unit 425 rotates counterclockwise in FIG. 4. In the meantime, the driving force continues to be transmitted to the transport member 424 by the driving unit 425, so that the transport member 424 continues to rotate in the direction of arrow C in FIG. 6. Since the transport member continues to rotate, the waste toner T is transported by the transport blade 424*b* of the transport member 424.

Here, when the transport member 424 is moved diagonally upward (in the direction of arrow E in FIG. 6), the gap between the cleaning blade 422 and the transport member 424 expands. As this gap expands, even in the case where the fluidity of the waste toner T is relatively poor, the waste toner T accumulated on the leading end side of the cleaning blade 422 enters the gap between the cleaning blade 422 and the transport member 424, and the area where the waste toner T comes into contact with the transport member 424 expands. In consequence, the waste toner T is transported by the transport member 424. Then, when the amount of the waste toner T accumulated decreases, the transport member 424 moves to its original position by the action of the springs 426.

(Advantage of Printer)

According to the printer 1 configured as described above, even the waste toner T whose fluidity is poor and whose amount of accumulation is likely to increase can be transported without stagnation as the transport member 424 moves diagonally upward (in the direction of arrow E in FIG. 6), the occurrence of faulty cleaning due to the clogging of the waste toner without being transported is prevented.

In addition, according to the printer 1 configured as described above, in cases such as where the fluidity of the waste toner is poor, the transport member 424 is moved along the elongated holes 421*a* by the accumulated waste toner. As the transport member 424 is moved, the belt 425*e* of the driving unit 425 moves. In consequence, the driving force continues to be transmitted to the transport member 424, so that the transport member 424 continues to rotate in the direction of arrow C in FIG. 6. For this reason, the transporting capability of the transport member 424 improves.

In addition, according to the printer 1 configured as described above, since the sponges 427 which close the elongated holes 421*a* and are deformed in conjunction with the movement of the transport member 424 are provided, the sponges 427 continue to close the elongated holes 421*a* without hampering the movement of the transport member 424 in the diagonally upward direction (direction of arrow E in FIG. 6) and to its original position. For this reason, the waste toner inside the housing 421 is prevented from scattering from the elongated holes 421*a* to outside the housing 421.

(Other Exemplary Embodiments)

The position at which the cleaning blade 422 comes into contact with the photoconductor drum 41 is not limited to the case of the above-described exemplary embodiment, and suffices if it is located above the center of the photoconductor drum 41.

In addition, the moving direction of the transport member 424 is not limited to the case of the above-described exemplary embodiment, and suffices if it is a direction of moving away from and approaching the cleaning blade 422, such as a vertical direction. Accordingly, the shape of the elongated hole 421*a* is not limited to the case where it is formed in the circular-arc shape, and may be rectilinear. In this case, the belt 425*e* is elongated or shrunk in conjunction with the movement of the transport member 424.

In addition, the place where the cleaning mechanism 42 is not limited to the case of the above-described exemplary embodiment, and may be a place where cleaning mechanism 42 abuts against an intermediate transfer member of an image forming apparatus having the intermediate transfer member such as a transfer belt.

In addition, the present invention is not limited to the case where the cleaning mechanism 42 has the springs 426, and the cleaning mechanism 42 may be constructed so as not to have the springs 426. In this case, when the amount of waste toner accumulated decreases, the transport member 424 which has been moved diagonally upward (in the direction of arrow E in FIG. 4) by the waste toner moves to its original position by the self weight of the transport member 424.

The present invention can be utilized in such as an image forming apparatus having a scanner function, a FAX function, or a copying function or these functions.

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention defined by the following claims and their equivalents.

What is claimed is:

1. A cleaning device comprising:

a removing unit that removes a toner on an image holder by coming into contact with the image holder that rotates;

a transporting unit provided above the removing unit and adapted to cause the toner removed by the removing unit to be axially transported as the transporting unit rotates; and an accommodating container in which the transporting unit is provided and which accommodates the removed toner, wherein the transporting unit is movable in a direction in which the transporting unit moves away from the removing unit.

2. The cleaning device according to claim 1, wherein the transporting unit comprises a rotating shaft and a supporting unit that supports the rotating shaft in a rotatable and displaceable state.

3. The cleaning device according to claim 2, wherein, in the supporting unit, the rotating shaft is supported by a member having a hole portion that extends in a direction in which the transporting unit moves, and the hole portion rotatably supports the rotating shaft movably in a direction in which the transporting unit moves.

4. The cleaning device according to claim 3, further comprising a closure unit that closes the hole portion, wherein the closure unit is deformed in conjunction with the movement of the transporting unit.

5. A cleaning device comprising:

a removing unit that removes a toner on an image holder by coming into contact with the image holder that rotates;

a transporting unit provided above the removing unit and adapted to cause the toner removed by the removing unit to be axially transported as the transporting unit rotates; and an accommodating container in which the transporting unit is provided and which accommodates the removed toner, wherein the transporting unit is moved by being pushed by the toner that moves in a direction apart from the removing unit.

6. The cleaning device according to claim 5, wherein the transporting unit comprises a rotating shaft and a supporting unit that supports the rotating shaft in a rotatable and displaceable state.

7. The cleaning device according to claim 6, wherein, in the supporting unit, the rotating shaft is supported by a member having a hole portion that extends in a direction in which the transporting unit moves, and the hole portion rotatably supports the rotating shaft movably in a direction in which the transporting unit moves.

8. The cleaning device according to claim 7, further comprising a closure unit that closes the hole portion, wherein the closure unit is deformed in conjunction with the movement of the transporting unit.

9. An image holder device comprising:

an image holder that rotates;

a removing unit that removes a toner on the image holder by coming into contact with the image holder that rotates;

a transporting unit provided above the removing unit and adapted to cause the toner removed by the removing unit to be axially transported as the transporting unit rotates; and an accommodating container in which the transporting unit is provided and which accommodates the removed toner, wherein the transporting unit is movable in a direction in which the transporting unit moves away from the removing unit.

10. An image forming apparatus comprising:

the image holder device according to claim 9;

a recording material supplying unit that supplies a recording material to the image holder device; and a transfer unit that transfers an image held on the image holder onto the recording material.

* * * * *